US005579098A

United States Patent [19]

Noguchi et al.

[11] Patent Number: 5,579,098

[45] Date of Patent: Nov. 26, 1996

[54] IMAGE FORMING APPARATUS WITH REMOVEABLE FIXING UNIT

[75] Inventors: Tomio Noguchi, Kawasaki; Yasuyoshi Hayakawa, Yokohama; Naoki Asano, Kawasaki; Kazunori Takashima, Kamakura, all of Japan

[73] Assignee: Canon Kabushiki Kaisha, Tokyo, Japan

[21] Appl. No.: 345,346

[22] Filed: Nov. 21, 1994

[30] Foreign Application Priority Data

Nov. 30, 1993 [JP] Japan ..... 5-299913
Oct. 4, 1994 [JP] Japan ..... 6-240034

[51] Int. Cl.[6] ..... G03G 15/20

[52] U.S. Cl. ..... 355/282; 355/309

[58] Field of Search ..... 355/200, 210, 355/282, 285, 308, 309, 319; 432/60; 219/216

[56] References Cited

U.S. PATENT DOCUMENTS 4,421,401 12/1983 Kagiura et al. ..... 432/60 X
4,531,823 7/1985 Deguchi et al. ..... 355/308
4,782,359 11/1988 Tomoe ..... 219/216 X
5,041,871 8/1991 Hata ..... 355/200
5,111,248 5/1992 Kita et al. ..... 355/282
5,155,537 10/1992 Komatsu et al. ..... 355/309

*Primary Examiner*—William J. Royer
*Attorney, Agent, or Firm*—Fitzpatrick, Cella, Harper & Scinto

[57] ABSTRACT

An image forming apparatus having a pressing unit for pressing a fixing unit so that the fixing unit is secured to the apparatus body by the pressing force of the pressing unit. A projection portion on the fixing unit and an insertion slit in the apparatus body also secure the fixing unit, and thus, screws for securing the fixing unit to the apparatus body can be omitted and the fixing unit can easily be attached/detached. A discharge cover is rotatably mounted to the apparatus body and the fixing unit is inserted through an opening portion created when the discharge cover is opened.

33 Claims, 12 Drawing Sheets

IMAGE FORMING APPARATUS WITH REMOVEABLE FIXING UNIT

BACKGROUND OF THE INVENTION

1. Field of the Invention

The present invention relates to an image forming apparatus, such as a copying machine or a printer, and more particularly to an image forming apparatus having a unit for fixing a non-fixed image.

2. Related Background Art

Hitherto, a major portion of an image forming apparatus typified by a laser beam printer has mainly comprised a developing unit for developing a latent image formed by a laser beam, a transferring means for transferring a developed toner image onto a sheet member, and a fixing unit for fixing the transferred toner image onto the sheet member. The fixing unit for fixing the transferred toner image to a paper sheet has usually comprised a heater, a fixing roller which is rotated while being heated to a predetermined level under control of a temperature sensor, and a pressure roller which is brought into contact with the fixing roller under predetermined pressure. The pressure roller follows the rotations of the fixing roller. The unit is adapted to a method in which toner serving as a developing material is melted by heat and pressure to fix the toner image to the sheet material.

FIG. 12 illustrates a laser beam printer that is a background of the present invention.

The printer body (the body of the image forming apparatus) has an upper portion 112 that comprises: a laser scanner 102; a process unit 101 including a photosensitive drum 163, a primary charger 162 and a developing unit 164; and paper discharge rollers 103. In a lower portion 111 of the printer body there is contained a transferring roller 109, a fixing unit 104, a pair of conveyance rollers 108, a paper feeding cassette 106, and paper feeding rollers (pickup rollers) 107.

The laser beam printer has expendable units, such as process unit 101 and the fixing unit 104, and expendable rollers, such as the paper feeding roller 107 and the transferring roller 109. The expendables must be changed several times during the life of the apparatus. In particular, the fixing unit must be changed two to four times during the life of the apparatus. Therefore, the fixing unit can be changed by opening the image forming apparatus in an alligator manner as shown in FIG. 12.

FIG. 13 is a perspective view of the fixing unit shown in FIG. 12.

The fixing unit 104 shown in FIG. 13 has a bottom plate 116 that is secured to the body of the apparatus by four screws 115. The fixing unit 104 can be removed from the body by removing the four screws 115 so as to be changed.

However, an apparatus of the foregoing type requires use of a screwdriver to change the fixing unit because the bottom plate of the fixing unit is secured to the body frame by screws. Furthermore, the change cannot easily be completed because many screws are used.

Since the fixing unit is secured to the body only by the bottom metal plate, the upper portion of the fixing unit is unstable, causing the upper portion thereof to encounter resonance from vibration of the rollers when rotating. The vibrations cause the drive transmission system of the apparatus to rotate irregularly. Thus, there arises a problem, for example, in that irregular pitch halftone horizontal lines are formed on the image. In order to overcome the foregoing problem, it might be considered feasible to increase the number of fixing screws or thicken the metal frame of the fixing unit. However, any of the foregoing countermeasures raises a problem that the cost and the weight cannot be reduced.

SUMMARY OF THE INVENTION

An object of the present invention is to provide an image forming apparatus having a fixing unit that can easily be attached/detached.

Another object of the present invention is to provide an image forming apparatus having a fixing unit portion in which jam recovery can easily be performed.

Another object of the present invention is to provide an image forming apparatus having a fixing unit that is secured to the apparatus body by the pressing force of a pressing member.

Another object of the present invention is to provide an image forming apparatus having an opening portion of a recording member discharge means through which a fixing unit is attached/detached.

Another object of the present invention is to provide an image forming apparatus having a fixing unit that is guided and moved by a guide member in a direction in which the recording member is moved when the fixing unit is attached/detached.

In accordance with these objects, there is provided an image forming apparatus comprising an apparatus body, image forming means mounted in the apparatus body for forming a non-fixed image on a recording member, a fixing unit for fixing the non-fixed image formed by the image forming means on the recording member, wherein the fixing unit is detachably mounted to the apparatus body, and pressing means for applying a pressing force against the fixing unit, wherein the fixing unit is secured to the apparatus body by the pressing force of the pressing means.

In accordance with another aspect of the invention, there is provided an image forming apparatus with an apparatus body, image forming means and fixing means, as described above, and a discharge means for discharging the recording member from the apparatus, the discharging means including a discharge cover rotatably mounted to the apparatus body so as to be opened and closed with respect to the apparatus body, wherein the fixing unit is attached and detached through an opening created when the discharge means is opened with respect to the apparatus body.

In accordance with yet another aspect of the invention, there is provided an image forming apparatus having an apparatus body, image forming means and fixing unit as described above, and a guide member for guiding the fixing unit in a direction in which the recording member is moved when the fixing unit is attached and detached.

Other and further objects, features and advantages of the invention will appear more fully from the following description.

DETAILED DESCRIPTION OF THE PREFERRED EMBODIMENTS

A preferred embodiment of the present invention will now be described with reference to the drawings.

Figure 1:
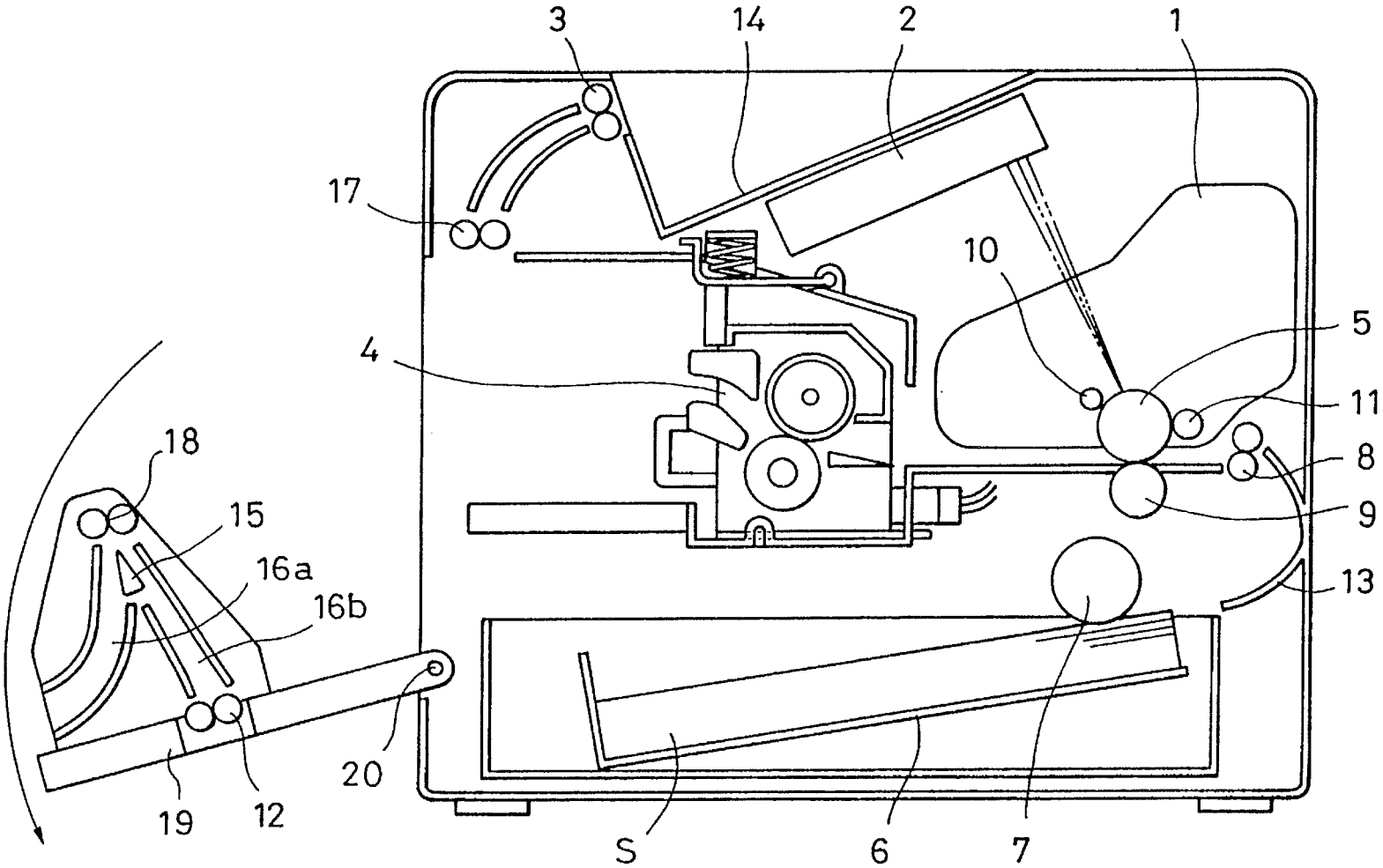
FIG. 1 is a cross sectional view which illustrates the overall structure of an image forming apparatus according to an embodiment of the present invention.

FIG. 1 is diagram which illustrates the overall structure of a laser beam printer that is an image forming apparatus according to an embodiment of the present invention.

Referring to FIG. 1, the printer body includes: a laser scanner 2; a process unit 1 including a photosensitive drum 5, a primary charger 10 and a developing unit 11; paper discharge rollers 3 and 12; a transferring roller 9; a fixing unit 4; a conveyance roller pair 8; a paper feeding cassette 6; and paper feeding rollers (pickup rollers) 7.

Recording sheet members S stacked in the paper feeding cassette 6 are fed by paper feeding rollers 7 that rotate counterclockwise (as viewed) so as to be guided and introduced by a sheet-member guide 13 into nipple portions of the conveyance roller pair 8.

Then, the sheet member S is conveyed by the conveyance roller pair 8 to the space between the photosensitive drum 5 and the transferring roller 9. The photosensitive drum 5 is rotated clockwise (as viewed) and uniformly electrically charged by a primary charger 10. The photosensitive drum 5 has an outer surface on which electrostatic latent images are sequentially formed by laser beams emitted by the laser scanner 2. The electrostatic latent images are developed by the developing unit 11 so that toner images are formed.

The toner images on the photosensitive drum 5 are sequentially transferred by the transferring roller 9 to the sheet member S as it is conveyed through the space between the photosensitive drum 5 and the transferring roller 9.

The sheet member S thus carrying the non-fixed toner image is moved to the fixing unit 4 so as to be heated and pressurized. Thus, the toner image is fixed to the sheet member S.

Then, the sheet member S is conveyed to paper-discharge rollers 17 by conveyance roller pair 18 and guide 16*a*. Paper discharge rollers 17 discharge the sheet member S face down onto a paper discharge tray 14 disposed on the upper surface of the printer body.

As an alternative to this, a flapper 15 for switching the conveyance passage for the recording member moves the recording member after it has passed through the conveyance roller pair 18 to the paper discharge rollers 12 while being guided by a guide 16*b*. Then, the recording member is discharged outside of the apparatus to the side and face up.

Reference numeral 19 represents a paper discharge cover that constitutes a portion of the outer portion of the apparatus body.

The paper discharge cover 19 can be rotated about supporting point 20 to be opened and closed. The paper discharge cover 19 has attached thereto the conveyance rollers 18 and the face-up paper-discharge rollers 12. Furthermore, the paper discharge cover 19 also has attached to it the guides 16*a* and 16*b* connected to the face-down and face-up discharge passages and the flapper 15 for switching between the foregoing passages.

The entire discharge means, such as the conveyance rollers 18, the flapper 15, the guides 16*a* and 16*b*, the paper discharge rollers 12 and the cover 19, can be opened/closed with respect to the apparatus body.

The image forming apparatus according to this embodiment has an arrangement that the fixing unit can be attached/detached through an opening portion formed by rotating paper discharge cover 19 to its open position.

As described above, this embodiment is able to simplify the structure of the apparatus without a necessity of providing an opening/closing portion for attaching/detaching the fixing unit.

Figure 2A:
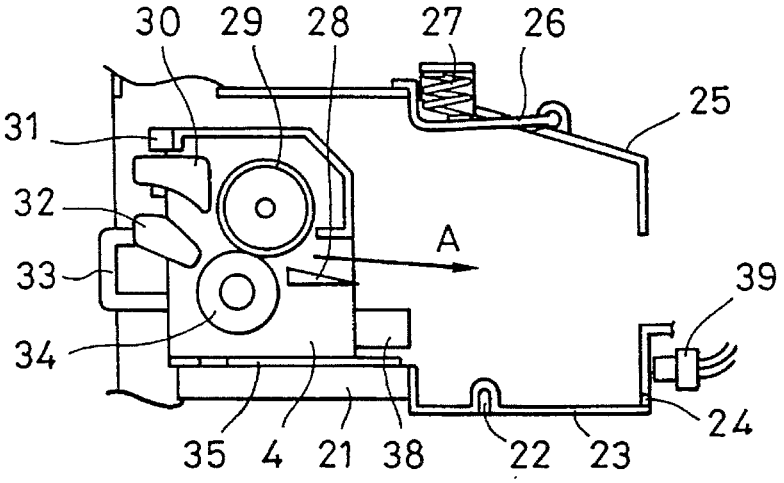
FIGS. 2 (*a*), 2 (*b*) and 2 (*c*) illustrate a mounting sequence for the fixing unit of the image forming apparatus shown in FIG. 1.
Figure 2B:
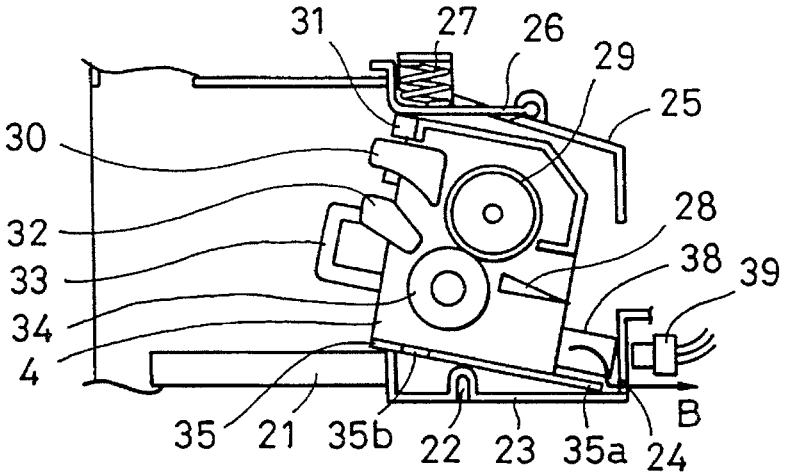
Figure 2C:
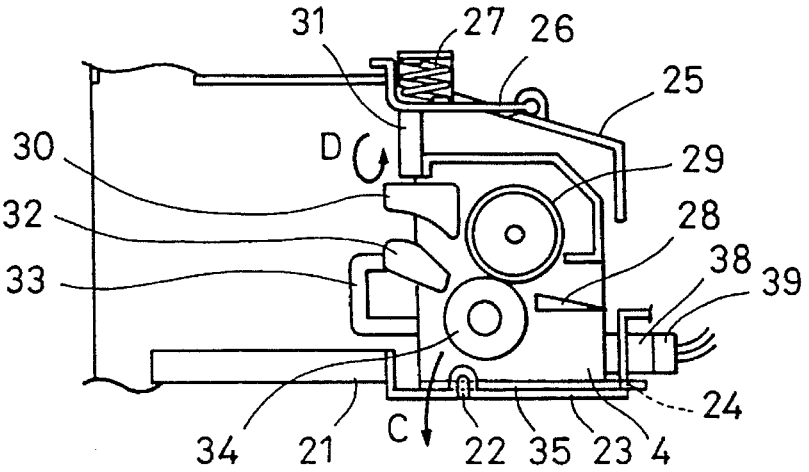

FIGS. 2 (*a*) to 2 (*c*) illustrate the sequence of steps performed when mounting fixing unit 4. Methods of mounting and securing the fixing unit 4 will now be described with reference to FIGS. 2 (*a*) to 2 (*c*).

As shown in FIG. 2, the fixing unit 4 comprises a fixing roller 29 and pressing roller 34, and the following elements disposed around fixing roller 29 and pressing roller 34: a frame 35 for supporting the fixing roller 29 and the pressing roller 34; an inlet guide 28 serving as a guide for the introduction of the paper; an upper separation guide 30 serving as a guide connected to the paper discharge port; a lower separation guide 32; a handle 33 that is held by the user when the fixing unit 4 is removed; and a fixing lever 31 for fixing the fixing unit 4 to the body.

The image forming apparatus comprises guide rails 21 on the side surface thereof. A body main frame 23 has a positioning boss 22 serving as a portion for positioning the body and a positioning insertion slit (an opening portion) 24. A upper fixing guide 25 has a pressing plate 26 which is pressed by a pressing spring 27 which serves as a pressing means.

As electric connectors, connectors 38 and 39 are provided on the fixing unit and the body, respectively. The connectors 38 and 39 establish the connections for the heater of the fixing unit, a thermistor for detecting the surface temperature of the fixing roller and a temperature fuse which serves as a safety device for cutting supply of electric power to the heater if the temperature has been raised excessively.

The fixing unit 4 is loaded by placing the lower portion of the frame 35 on the guide rails 21 as shown in FIG. 2 (*a*). Then, the fixing unit 4 is pushed in a direction represented by an arrow A shown in FIG. 2 (*a*) which is a direction opposite in which the recording member is moved.

The fixing unit 4 is pushed into the apparatus until the upper portion of the fixing unit 4 is brought into contact with the upper fixing guide 25. Thus, the fixing unit 4 is pushed downwards so that it is inclined as shown in FIG. 2 (*b*). Therefore, a projection 35*a* formed in the leading portion of the frame 35 and serving as a portion for positioning the unit is inserted into the positioning insertion slit 24 in a direction represented by an arrow B shown in FIG. 2 (*b*).

When the fixing unit 4 is pushed further inward, the fixing unit 4 passes the guide rails 21 as shown in FIG. (*c*). Then, the fixing unit 4 is moved in a direction represented by an arrow C shown in FIG. 2 (*c*) so that the positioning boss 22 is inserted into the opening portion 35*b* which is a unit positioning portion of the frame 35. Thus, positioning is established. Since the connectors 38 and 39 of the fixing unit 4 can be inserted/removed in accordance with the sliding movement of the fixing unit 4, they are connected when the fixing unit 4 has been positioned.

By twisting the fixing lever 31, the fixing lever 31 presses the pressing plate 26 to hold the upper portion of the fixing unit 4 from an upper position. Then, the pressing means 27 presses the fixing unit 4 to the positioning boss 22.

That is, the fixing lever 31 serves as a switch means for switching transmission/interruption of pressuring force to the fixing unit 4.

Figure 3:
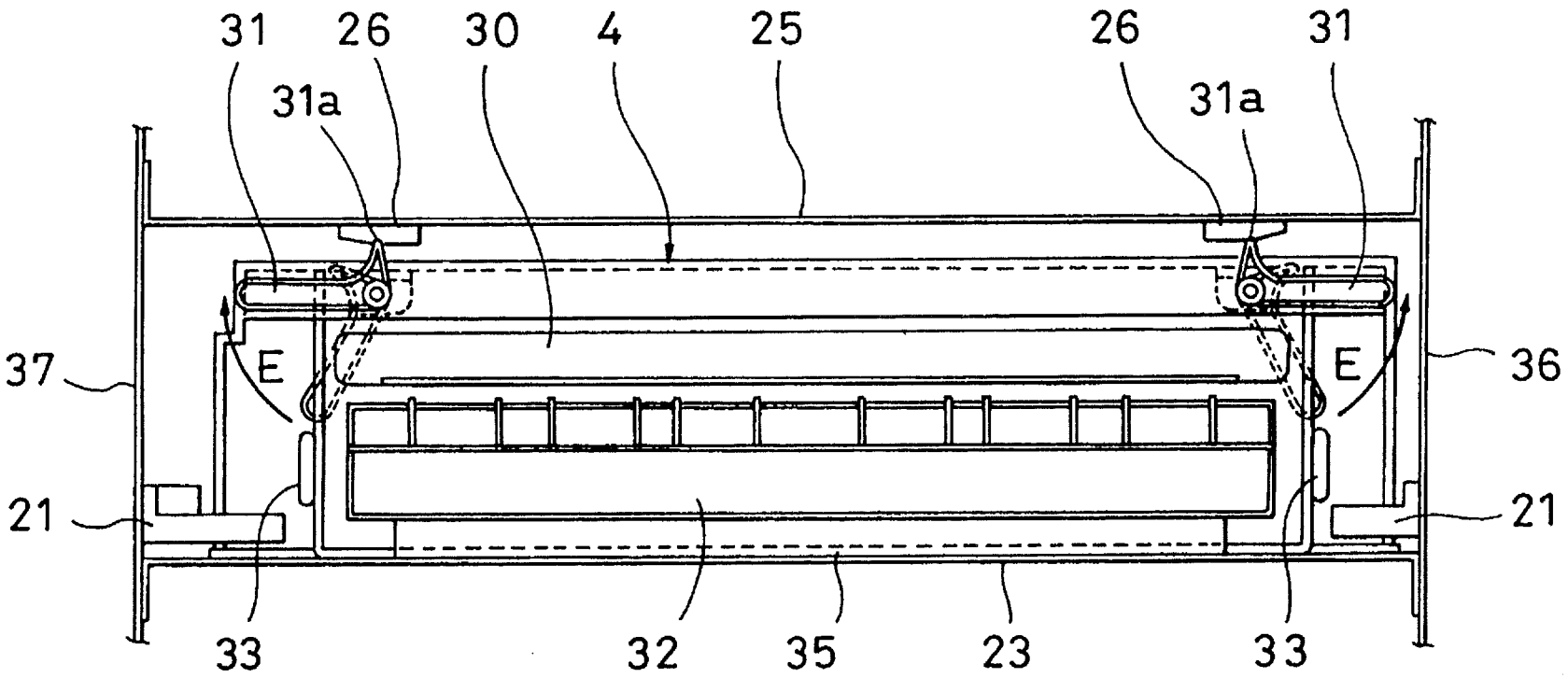
FIG. 3 is a diagram which illustrates a lever for fixing the fixing unit of the image forming apparatus.

FIG. 3 is a view which illustrates the body, on which the fixing unit 4 has been secured, when viewed from the paper discharge cover port.

The fixing unit 4 is pressed and secured between the body main frame 23 and the upper fixing guide 25, the body main frame 23 being a horizontal stay for the body. The body main frame 23 and the upper fixing guide 25 are attached to the front and rear side plates 36 and 37 of the body. Thus, a box-like shape, which helps to damper vibration, is formed.

The frame 35 has a U-shape facing side, and comprises a bottom surface placed on the body main frame 23. The right and left side plates of the frame 35 support the fixing roller 29 and the pressing roller 34, the side plates having handles 33 and so forth.

Two fixing levers 31 are, as shown in FIG. 3, disposed adjacent to the side plates (metal plates) of the frame 35. Frame 35 is a structural member of the fixing unit 4. Therefore, the pressure of the fixing lever 31 is received by the frame 35. As a result, even when the fixing lever 31 is pressed downward with extra force, deformation of the frame 35, the fixing unit 4 and the rollers can be prevented, and thus the fixing performance and conveyance easiness can be maintained.

When the fixing lever 31 is, as shown in FIG. 3, rotated in a direction represented by an arrow E shown in FIG. 3, a projection 31a of the fixing lever 31 is received in a groove formed in the pressing plate 26.

When the fixing unit 4 is removed, a contrary procedure is employed such that the fixing lever 31 is rotated in a direction opposite to that represented by the arrow E shown in FIG. 3 so that pressing plate 26 is suspended. By raising and holding the handle 33 to remove the fixing unit 4, the fixing unit 4 can then be removed from the body of the image forming apparatus.

In this embodiment, the fixing unit 4 is loaded in such a manner that the fixing unit 4 is, from a side position, inserted along the guide rails 21. The foregoing method facilitates the changing operation as compared with the method in which the body of the image forming device is opened in an alligator manner. This embodiment has a structure that the guide rails 21 and the upper fixing guide 25 are used to align the fixing unit 4 with the positioning boss 22 which projects above the horizontal surface of the body main frame 23. The positioning operation using the boss formed on the horizontal surface of the body main frame is effective to secure the units in parallel to each other as compared with securing the same by horizontally pushing the units. The fixing lever 31 according to this embodiment enables the screws to be omitted. The body main frame 23 of the fixing unit 4 having the positioning boss 22 is formed into an integral stay structure together with the stationary portions, such as the process cartridge 1 and the transferring roller 9.

As described above, this embodiment has the structure that the fixing unit is secured to the apparatus body with the pressing force of the pressing means. Therefore, screws for fixing can be omitted and the attachment/detachment of the fixing unit can be performed very easily.

Since the fixing unit is, in this embodiment, removed in such a manner that the fixing unit is guided by the guide rails and moved in a direction parallel to the direction in which the recording member is moved, a problem of the following type can be prevented: a jammed recording member is broken due to lateral force (force in a direction perpendicular to the direction in which the recording member is moved) when the fixing unit is removed. Thus, the recording member can be removed smoothly in the direction in which the fixing unit is removed.

An embodiment for preventing vibrations of the fixing unit and thus capable of further reliably securing the fixing unit will now be described.

In order to overcome the problem of the irregular pitch halftone horizontal lines and to avoid the use of screws, reaction to the drive force of the drive system must be considered. An image forming apparatus according to this embodiment is intended to easily change the fixing unit and to prevent looseness of the same due to reaction to the drive force of the drive system.

Figure 4:
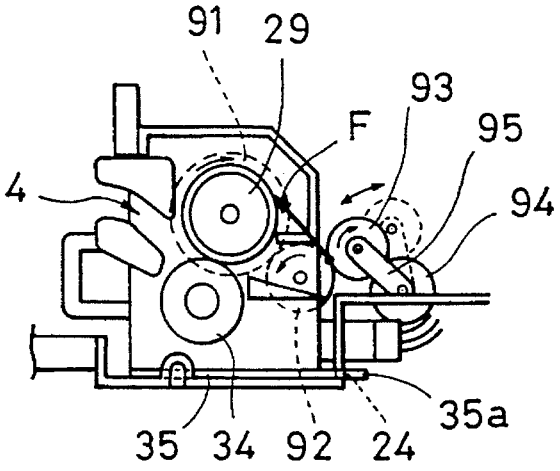
FIG. 4 is a diagram which illustrates a drive system for operating the fixing unit.

As shown in FIG. 4, a fixing roller 29 has a fixing roller gear 91 attached thereto. The fixing roller gear 91 is operated by a fixing roller drive gear 92 provided for the fixing unit 4. The apparatus body has a movable gear 93 for operating the fixing roller drive gear 92, the movable gear 93 being movably disposed via connector 95 relative to an idler gear 94 so that drive force is transmitted when the fixing unit 4 is mounted. The foregoing gears are rotated in directions represented by corresponding arrows placed on the gears. The foregoing rotational directional relationship causes the reaction to the drive force of the drive system to be added to the fixing unit 4 in the direction represented by arrow F. The reaction force F acts in a direction urging the overall body of the fixing unit 4 to move upwards. If positioning projection 35*a* of the fixing unit 4 loosens from the positioning insertion slit 24 in the foregoing structure, the fixing unit 4 will vibrate vertically. Thus, a problem of irregular pitch on the formed image arises.

The structure of this embodiment will now be described. In this embodiment, projection portion 35'*a* for positioning the fixing unit 4 has elasticity and is bent by an angle $\alpha$ as shown in FIG. 5 (*a*) to allow for easy insertion of the positioning portion 35'*a* of the fixing frame of the fixing unit 4 into the positioning insertion slit 24 of the body main frame 23 when the fixing unit 4 is inserted into a direction represented by an arrow A.

Figure 5A:
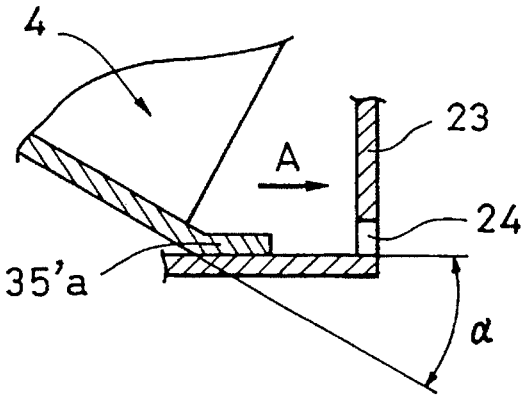
FIGS. 5 (*a*) and 5 (*b*) illustrate a positioning and securing sequence for the fixing unit.
Figure 5B:
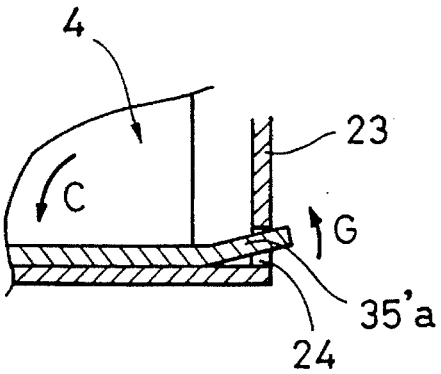

As shown in FIG. 5 (*b*), when the fixing unit 4 is pressed into position in a direction C and secured to the body main frame 23, the projection portion 35'*a* of the fixing frame, is urged upward in a direction G, and presses the upper portion of the positioning insertion slit 24 due to the spring force of the bent portion. Therefore, the fixing unit 4 can reliably be secured and vertical looseness occurring due to the reaction of the drive system can be prevented.

An air passage formed around the fixing unit for use in the method of loading the fixing unit from a horizontal position will now be described.

Figure 6:
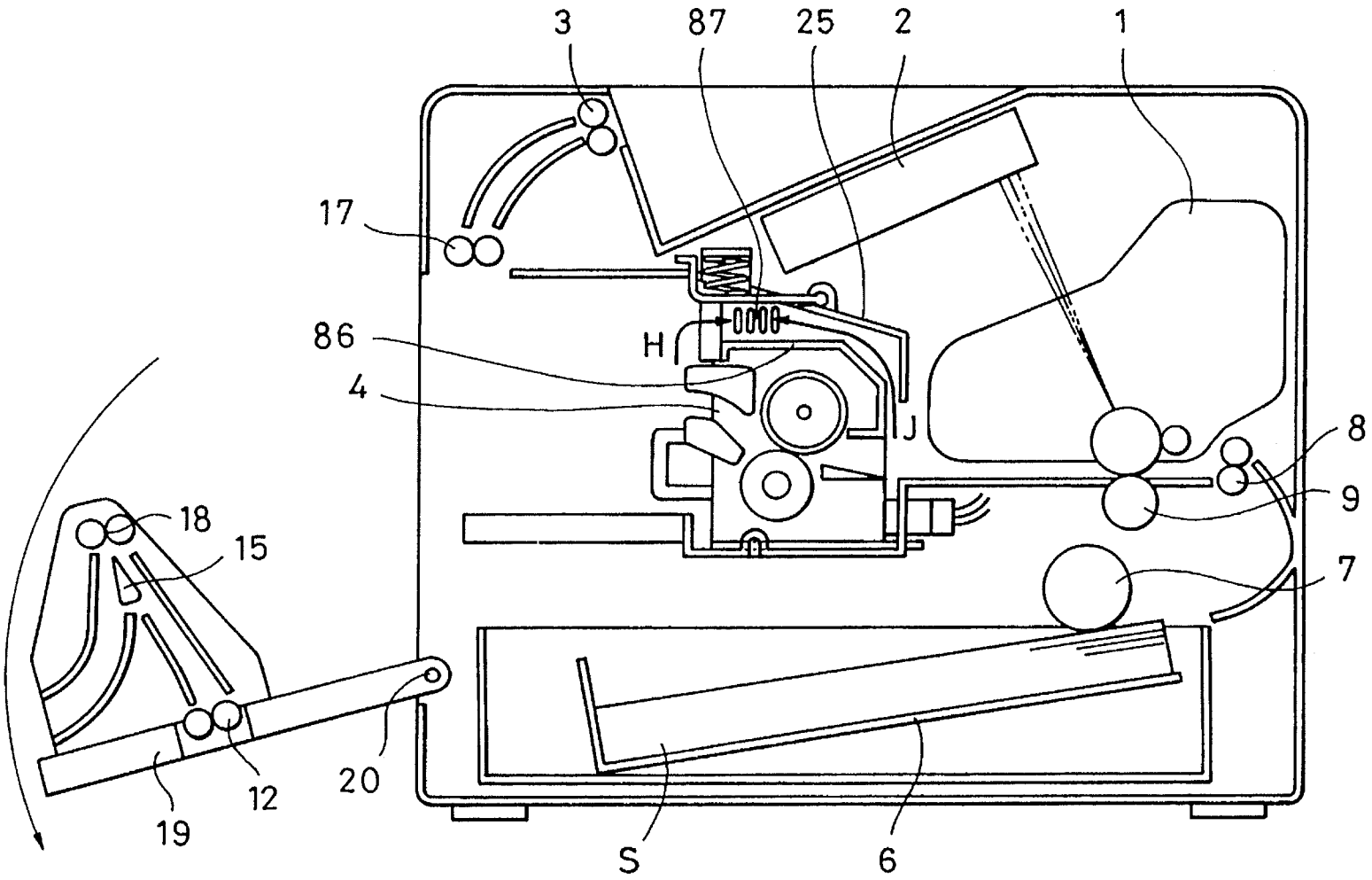
FIG. 6 is a diagram which illustrates an air passage formed around the fixing unit.

As shown in FIG. 6, the fixing unit 4 is disposed at substantially the central portion of the apparatus body. In the foregoing case, there arises a problem that the process unit 1 and the scanner 2 are heated by the fixing unit 4. Therefore, a shield plate or the like must be used to block the transmission of heat and steam generated by the fixing unit 4 toward the process unit 1 and the scanner 2. Furthermore, a duct must be provided for the purpose of relieving hot air.

In this embodiment, the upper fixing guide 25 for guiding the fixing unit 4 to be secured serves as the heat shielding plate and as well as the duct for forming the air passage. The upper fixing guide 25 has a moderate upward slope from the right portion toward the paper discharge cover 19 as viewed in FIG. 6. The slope naturally vents steam generated near the paper inlet port of the fixing unit 4 in a direction represented by an arrow J. A duct is formed between the upper guide 25 and the upper cover 86 of the fixing unit 4 so that hot air in the upper fixing portion of the fixing unit 4 is discharged through an air discharge portion 87. Also steam generated around the outlet port of the fixing unit 4 is allowed to pass through the upper portion and the duct so as to be discharged through the air discharge portion 87 as represented by an arrow H.

Since this embodiment has a structure such that the fixing unit is loaded from a position adjacent to the paper discharge portion and the space in the apparatus body, into which the fixing unit is loaded, is formed into the box-like shape, the fixing unit can be completely surrounded and the air passage with other units, such as the process 1 and the scanner 2, can be interrupted. In addition, the upper fixing guide 25 insulates heat transmission because a box-like shape is employed.

As described above, the upper fixing guide 25 according to this embodiment also serves as a duct for venting hot air by forming an air passage and as a heat shielding plate as well as a member for inserting the fixing unit 4.

Another embodiment of the present invention will now be described with reference to FIGS. 7 and 8.

This embodiment has the basic structure as that of the foregoing embodiment and only different portions will now be described.

Figure 7:
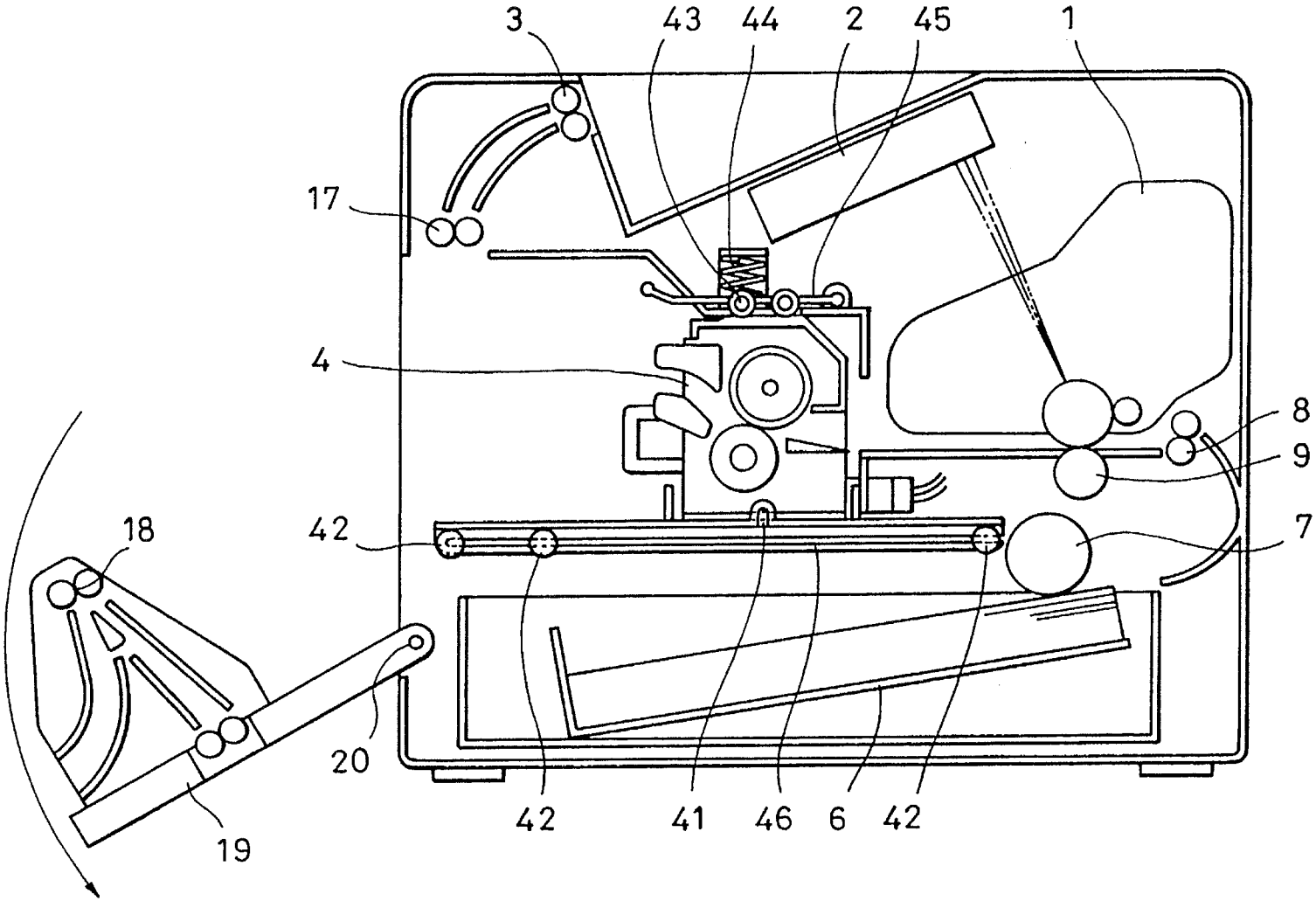
FIG. 7 is a cross sectional view which illustrates the overall structure of an image forming apparatus according to another embodiment of the present invention.

An image forming apparatus according to this embodiment, as shown in FIG. 7, comprises the fixing unit 4 which is placed on a stay 46 that is a support frame. The stay 46 is able to slide due to it being mounted on rollers 42.

Figure 8:
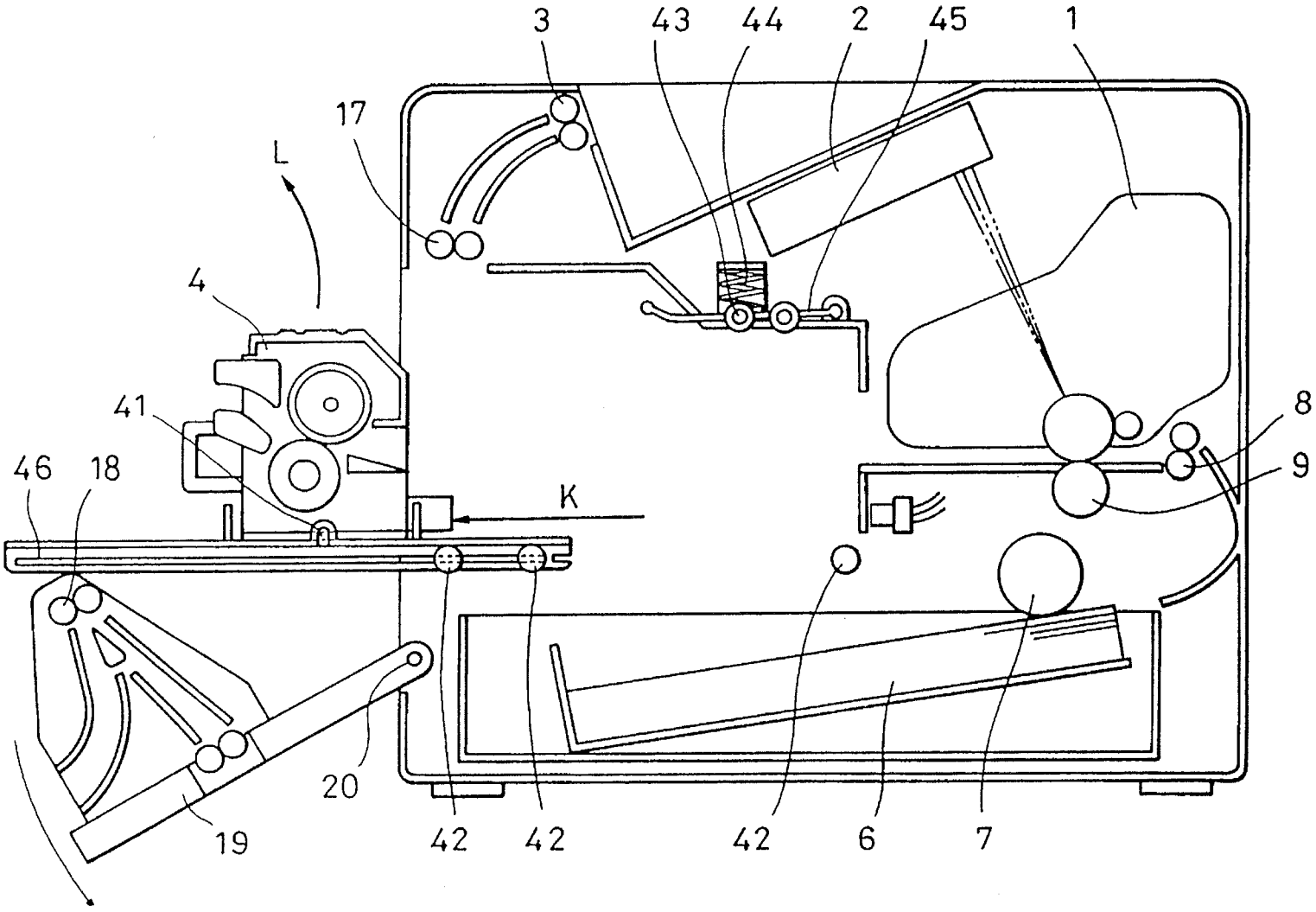
FIG. 8 is a diagram which illustrates the fixing unit of the image forming apparatus shown in FIG. 4 mounted on the image forming apparatus.

When the fixing unit 4 is pulled in a direction represented by an arrow K shown in FIG. 8, the fixing unit 4, together with the stay 46, slides out as shown in FIG. 8. If the fixing unit 4 is then moved upwards in a direction represented by an arrow L shown in FIG. 8, the fixing unit 4 can be removed.

When the fixing unit 4 is loaded, the stay 46 is drawn and, in this state, the fixing frame of the fixing unit 4 is aligned to a positioning boss 41 of the stay 46. Then, the stay 46 is slid and pushed inward so that the upper portion of the fixing unit 4 is pressed and held by pressing rollers 43 attached to a pressing plate 45 urged by a spring 44. Thus, the fixing unit 4 is brought to a state shown in FIG. 7 and secured to the body.

An advantage of this embodiment is to smoothly move the fixing unit when the fixing unit is attached/detached. Furthermore, the fixing unit can be pressed during the insertion of the fixing unit. That is, a method capable of simply attaching/detaching a fixing unit can be provided.

Another embodiment of the present invention will now be described with reference to FIGS. 9 and 10.

Figure 9:
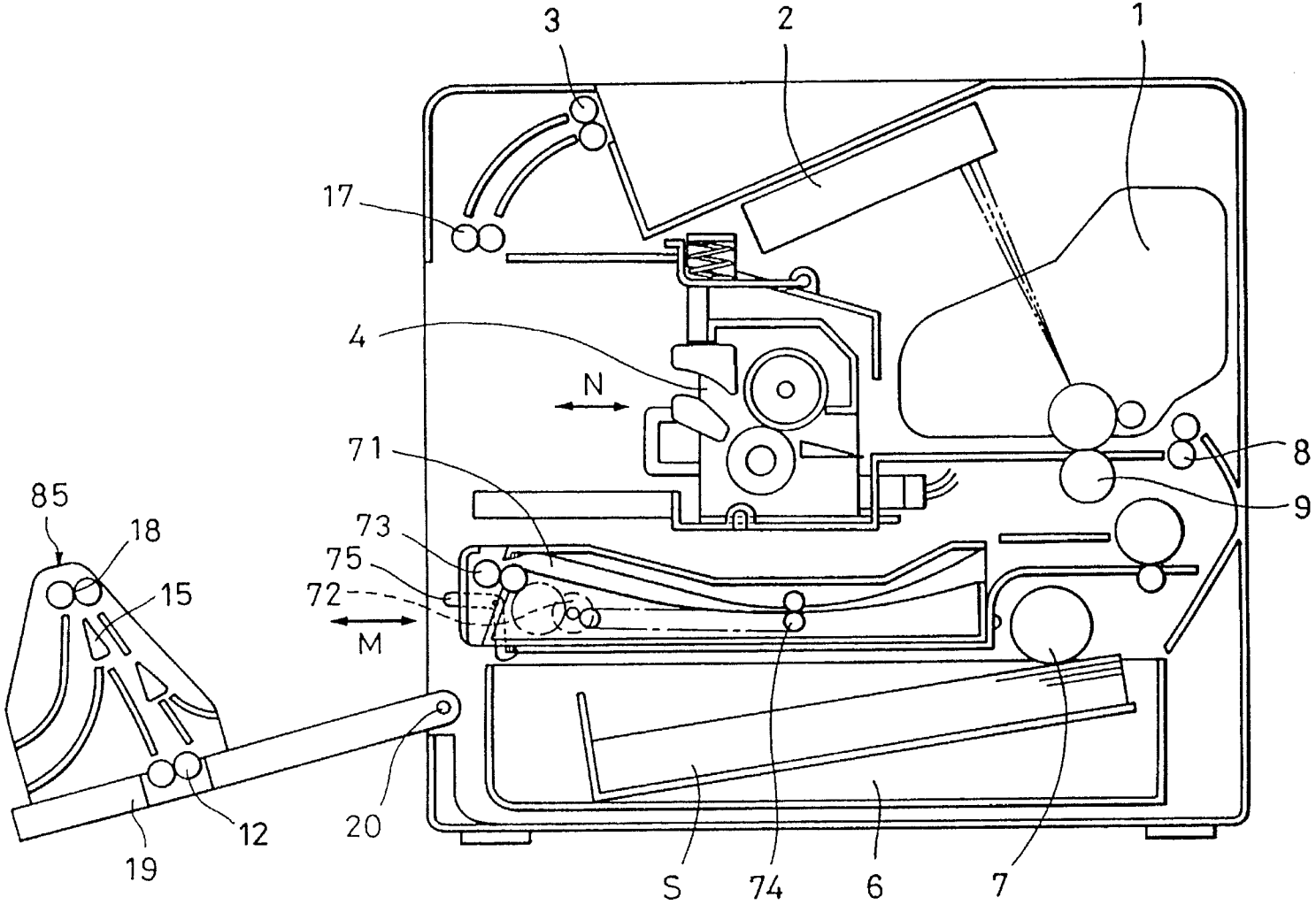
FIG. 9 is a cross sectional view which illustrates the overall structure of an image forming apparatus according to another embodiment of the present invention.

As shown in FIG. 9, a double-sided unit 71 serving as an accessory is disposed in the apparatus body. The double-sided unit 71 comprises two pair of conveyance rollers 73 and 74 and a drive motor 72. The double-sided unit 71 is made attachable/detachable with respect to the apparatus body in a direction represented by an arrow M shown in FIG. 9. The double-sided unit 71 can be removed from the body by opening the paper discharge cover 19 and operating a lock claw 75. In the foregoing state, the units of the apparatus can be maintained.

The structure of this embodiment is characterized in that both double-sided unit 71 and the fixing unit 4 have a common opening portion (an opening portion of a discharge means) and are attached/removed in the same directions (M and N). Furthermore, the paper discharge cover 19 is a door that is also opened when a jam between the fixing unit 4 and the paper discharge rollers 17 needs to be overcome.

Therefore, this embodiment enables the changes of the fixing unit and the double-sided unit and an operation for overcoming jamming to be performed simply by opening the paper discharge cover 19.

That is, both fixing unit and the double-sided unit can be changed with one convenient action, causing excellent operationality to be obtained. Furthermore, the jam removed door and the changing port are the same. Therefore, excessive facility such as the door for the change and labor of removing the outer frame can be omitted. Thus, the unit can be changed by a simple method.

Therefore, an image forming apparatus in which the units can easily be attached/detached and which can easily be maintained can be provided.

In this embodiment, the fixing lever for pressing the fixing unit from an upper position is also used as a ground point to establish a grounding function.

Figure 10:
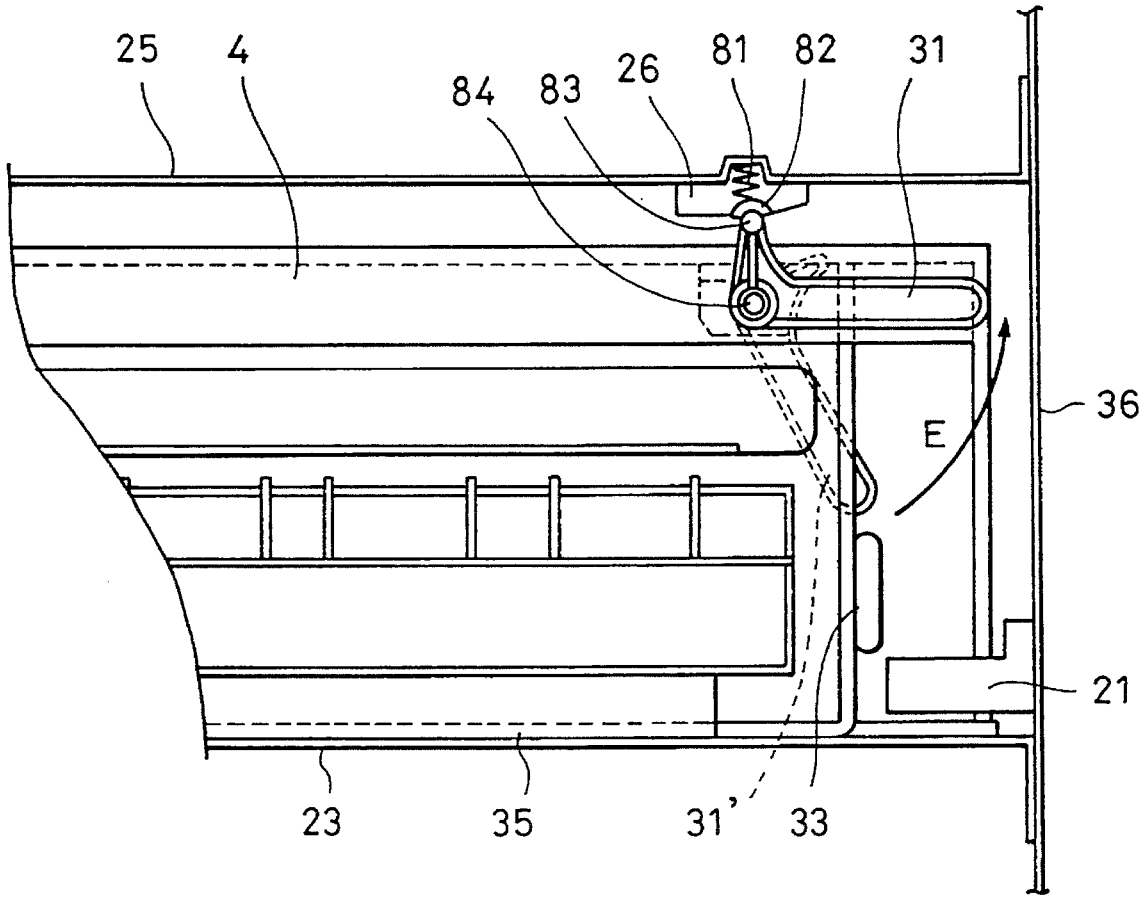
FIG. 10 is a detailed view which illustrates the fixing lever shown in FIG. 9.

As shown in FIG. 10, the fixing lever 31 has a leading portion in which a ground contact 83 is formed. The contact 83 is connected to the frame 35 of the fixing unit 4 through a pin 84 about which the fixing lever 31 rotates. The frame 35 serves as a ground for the fixing unit 4. The pressing plate 26 of the apparatus body has a contact 82 and a contact spring 81. The contact spring 81 is, through the upper fixing guide 25, connected to the body main frame 23 which is the ground for the apparatus body. In a state where locking is suspended, the fixing lever 31 is at a position designated by a dashed line 31', the position being a position to which a paper discharge cover abutting portion 85 shown in FIG. 9 is moved when the paper discharge cover 19 is closed. That is, in the state where the fixing lever 31 is suspended, the paper discharge cover abutting portion 85 abuts against the fixing lever 31 and thus the paper discharge cover 19 cannot be closed. If the paper discharge cover 19 is not closed, the apparatus cannot be operated. The locking position for the fixing lever 31 is the portion rotated in the direction E and the fixing unit 4 is secured to the apparatus body at the foregoing position.

As described above, since this embodiment has the arrangement where the fixing lever 31 is used as a ground, the interchangeability of the fixing unit 4 cannot deteriorate. When the fixing unit 4 has been mounted on the body and locked, the upper portion of the fixing unit 4 can be grounded reliably. Furthermore, undesirable operation of the body while leaving locking of the fixing unit can be prevented.

Figure 11:
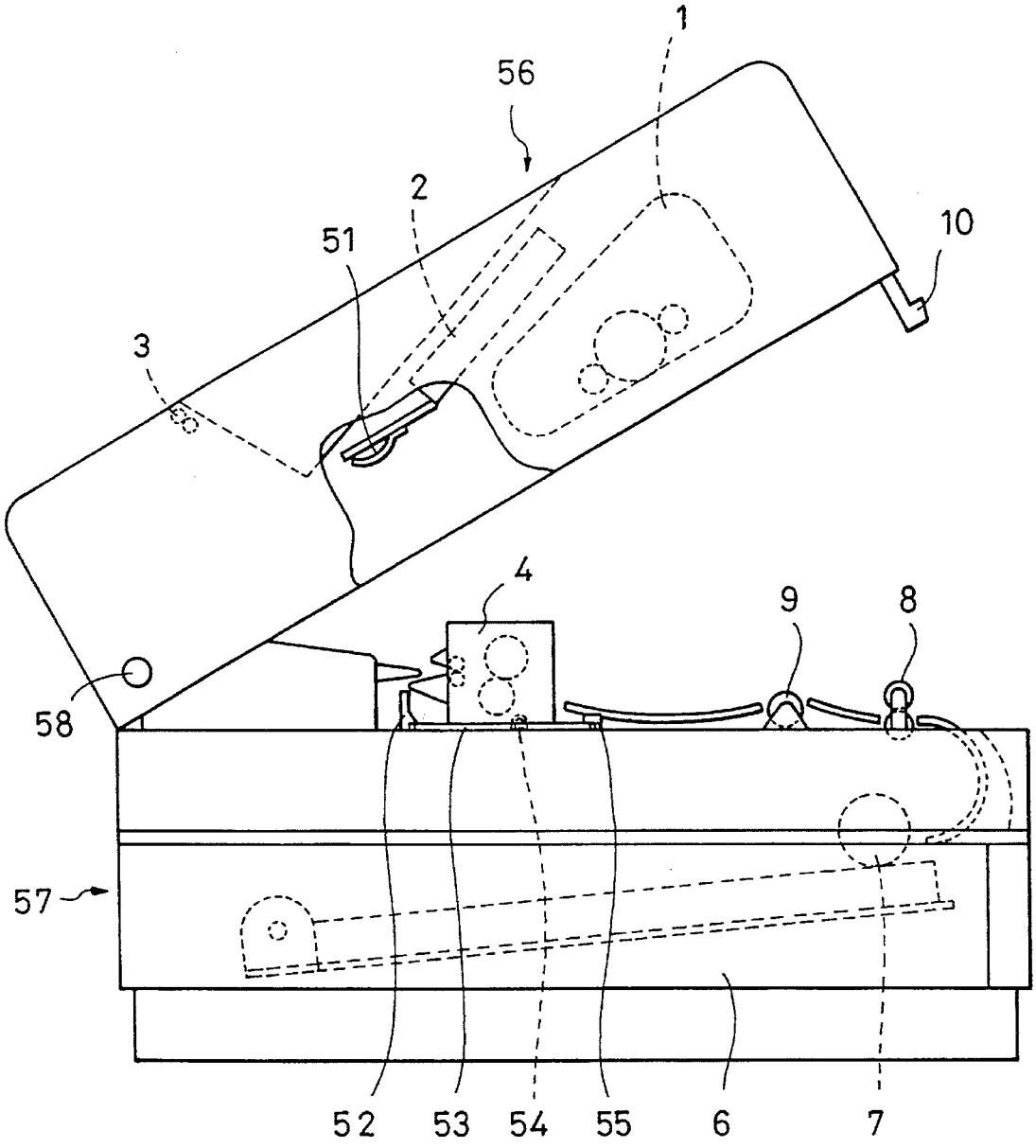
FIG. 11 is a diagram which illustrates the overall structure of an image forming apparatus according to another embodiment of the present invention.
Figure 12:
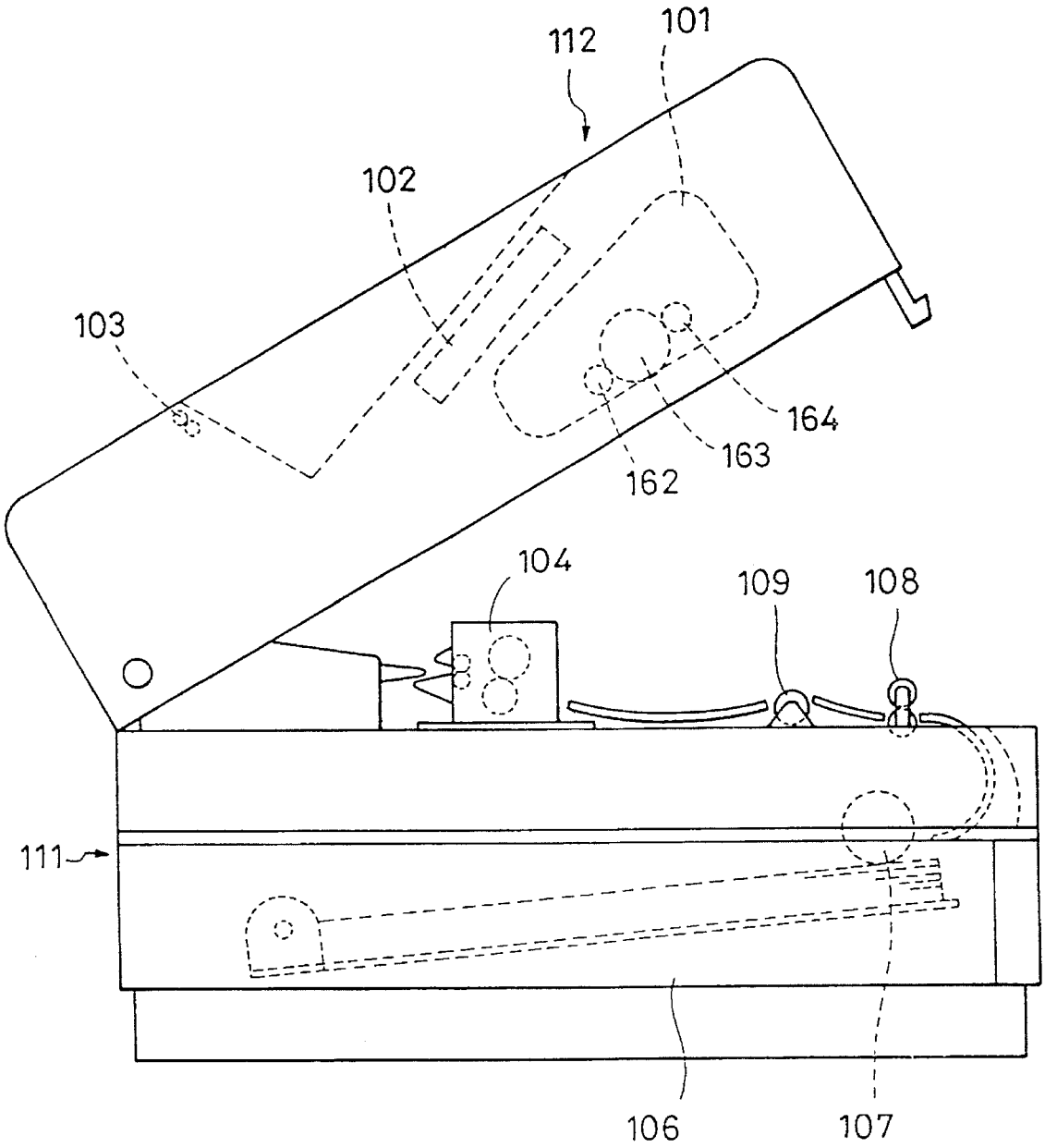
FIG. 12 PRIOR ART
FIG. 12 is a diagram which illustrates a conventional image forming apparatus.
Figure 13:
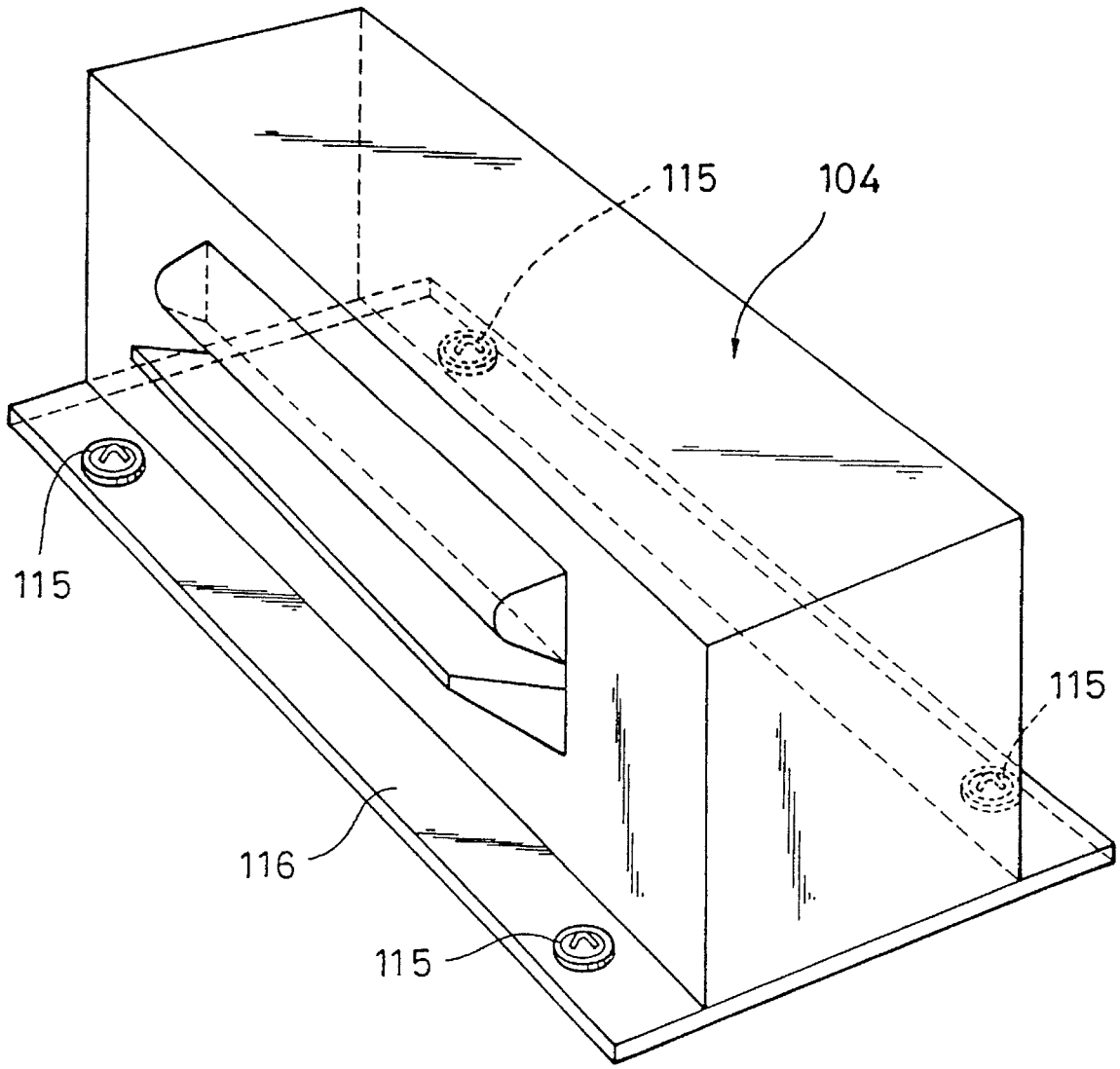
FIG. 13 PRIOR ART
FIG. 13 is a perspective view which illustrates the fixing unit shown in FIG. 12.

Referring to FIG. 11, another embodiment of the present invention will now be described.

An image forming apparatus according to this embodiment is constituted such that the changing facility can be improved with a necessity of simply modifying the fixing unit while preventing the vibrations of the upper portion.

As shown in FIG. 11, the image forming apparatus according to this embodiment has a structure that an upper frame 56 that can be opened/closed relative to a hinge 58 with respect to a lower frame 57 and secured by latch 10.

As shown in FIG. 11, a bottom plate 53 of the fixing unit 4 is aligned to a positioning boss 54 formed in the lower portion of the body of the image forming apparatus and fixed to the body of the image forming apparatus by fixing claws 52 and 55. When the upper frame 56 of the body of the image forming apparatus is closed in the foregoing state, the pressing spring 51 presses the upper portion of the fixing unit 4 so that the fixing unit 4 can be reliably secured.

When the fixing unit 4 is removed, the upper frame 56 of the image forming apparatus is opened, the fixing claw 52 is bent in a direction opposing the fixing unit 4 and the fixing unit 4 is moved upwards.

Also this embodiment enables an effect similar to that obtainable from the foregoing embodiment to be obtained.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. An image forming apparatus comprising:

an apparatus body;

image forming means mounted in said apparatus body for forming a non-fixed image on a recording member;

a fixing unit for fixing the non-fixed image formed by said image forming means on the recording member, wherein said fixing unit is detachably mounted to said apparatus body; and pressing means for applying pressing force against said fixing unit wherein said fixing unit is secured to the apparatus body by the pressing force of said pressing means wherein said apparatus body further includes an insertion slit and said fixing unit further includes an elastic projection portion, said projection portion insertable into said insertion slit and elastically deformed when said fixing unit is mounted.

2. An image forming apparatus according to claim 1, wherein said fixing unit includes switch means for switching between a transmission state where the pressing force applied by said pressing means is transmitted to said fixing unit and a non-transmission state.

3. An image forming apparatus according to claim 2, wherein said switch means includes a ground contact and said fixing unit is grounded when said switch means is in the transmission state.

4. An image forming apparatus according to claim 2, wherein said switch means is a rotatable lever.

5. An image forming apparatus according to claim 1, wherein said pressing means applies the pressing force against said fixing unit when said fixing unit is mounted.

6. An image forming apparatus according to claim 1, wherein said pressing means includes a spring.

7. An image forming apparatus according to claim 1, wherein:

said apparatus body further includes a positioning member; and said fixing unit further includes a unit position portion engageable with said positioning member upon mounting of said fixing unit.

8. An image forming apparatus according to claim 1, further comprising a slidable supporting frame on which said fixing unit is mounted.

9. An image forming apparatus comprising:

an apparatus body;

image forming means for forming a non-fixed image on a recording member;

a fixing unit for fixing the non-fixed image formed by said image forming means on the recording member, wherein said fixing unit is detachably mounted to said apparatus body; and discharge means for discharging the recording member from said image forming apparatus, said discharge means including a discharge cover rotatably mounted to said apparatus body so as to be opened and closed with respect to the apparatus body, wherein said fixing unit is attached and detached through an opening portion created when said discharge means is opened with respect to the apparatus body.

10. An image forming apparatus according to claim 9, wherein said discharge means discharges the recording member fixed by said fixing unit.

11. An image forming apparatus according to claim 9, wherein said discharge cover constitutes a portion of an exterior of said apparatus body.

12. An image forming apparatus according to claim 9, further comprising pressing means for applying a pressing force against said fixing unit, wherein said fixing unit is secured to said apparatus body by the pressing force of said pressing means.

13. An image forming apparatus according to claim 12, wherein said fixing unit includes switch means for switching between a transmission state where the pressing force applied by said pressing means is transmitted to said fixing unit and a non-transmission state.

14. An image forming apparatus according to claim 13, wherein closing of said discharge cover is inhibited when said switch means is in a non-transmission state.

15. An image forming apparatus according to claim 9, wherein a portion of said image forming means is accessable for attachment and detachment when the discharge cover is open.

16. An image forming apparatus according to claim 15, wherein the accessable portion of said image forming means is a conveyance unit for conveying the recording member for forming images on two sides of the recording member.

17. An image forming apparatus according to claim 9, wherein:

said apparatus body further includes a positioning member; and said fixing unit further includes a unit positioning portion, said unit positioning portion engageable with said positioning member upon mounting of said fixing unit.

18. An image forming apparatus according to claim 9, wherein said apparatus body further includes an insertion slit, and said fixing unit further includes an elastic projection portion, said projection portion insertable into said insertion slit and elastically deformed when said fixing unit is mounted.

19. An image forming apparatus according to claim 9, further comprising a slidable supporting frame on which said fixing unit is mounted.

20. An image forming apparatus according to claim 9, wherein said discharge means includes a conveyance roller for conveying a recording member.

21. An image forming apparatus according to claim 9, further comprising a guide member for guiding said fixing unit in a direction in which the recording member is moved when said fixing unit is attached and detached.

22. An image forming apparatus comprising:

an apparatus body;

image forming means mounted in said apparatus body for forming a non-fixed image on a recording member;

a fixing unit for fixing the non-fixed image formed by said image forming means on the recording member while conveying the recording member, wherein said fixing unit is detachably mounted to said apparatus body;

a guide member for guiding said fixing unit in a direction in which the recording member is moved when said fixing unit is attached and detached; and pressing means for applying a pressing force against said fixing unit, wherein said fixing unit is secured to said apparatus body by the pressing force of said pressing means.

23. An image forming apparatus according to claim 22, wherein said guide member is a guide rail.

24. An image forming apparatus according to claim 22, wherein said guide member is a rotative roller.

25. An image forming apparatus according to claim 22, further comprising discharge means which can be opened and closed with respect to the apparatus body and arranged for discharging the recording member to the outside of said apparatus, wherein said fixing unit is attached and detached through an opening created when said discharge means is opened with respect to the apparatus body.

26. An image forming apparatus according to claim 22, further comprising a slidable supporting frame on which said fixing unit is mounted.

27. An image forming apparatus according to claim 22, wherein said guide member forms a path for venting excess heat.

28. An image forming apparatus according to claim 22, wherein said guide member is made of a heat blocking material.

29. An image forming apparatus comprising:

an apparatus body;

image forming means mounted in said apparatus body for forming a non-fixed image on a recording member;

a fixing unit for fixing the non-fixed image formed by said image forming means on the recording member while conveying the recording member, wherein said fixing unit is detachably mounted to said apparatus body;

a guide member for guiding said fixing unit in a direction in which the recording member is moved when said fixing unit is attached and detached;

wherein said apparatus body further includes a positioning member; and said fixing unit further includes a unit positioning portion, said unit positioning portion being engageable with said positioning member.

30. An image forming apparatus according to claim 29, wherein said apparatus body further includes an insertion slit, and said fixing unit further includes an elastic projection portion, said projection portion insertable into said insertion slit and elastically deformed when said fixing unit is mounted.

31. An image forming apparatus comprising:

an apparatus body;

image forming means for forming a non-fixed image on a recording member;

a fixing unit for fixing the non-fixed image formed by said image forming means on the recording member, wherein said fixing unit is detachably mounted to said apparatus body; and discharge means for discharging the recording member from said apparatus, said discharge means being opened and closed with respect to the apparatus body, wherein said fixing unit is attached and detached through an opening portion created when said discharge means is opened with respect to the apparatus body.

32. An image forming apparatus according to claim 31, wherein said discharge means includes a cover having an opening which the recording member goes through.

33. An image forming apparatus according to claim 31, wherein said discharge means includes a conveyance roller for conveying a recording member.

* * * * *